US011365935B2

(12) United States Patent
Luebbers

(10) Patent No.: US 11,365,935 B2
(45) Date of Patent: Jun. 21, 2022

(54) HEATING COMPARTMENT FOR SUPPLYING HEAT AND SPRAY DRYER FOR DRYING AN ARTICLE WHICH IS TO BE DRIED

(71) Applicant: LUEBBERS ANLAGEN-UND UMWELTTECHNIK GMBH, Bad Langensalza (DE)

(72) Inventor: Matthias Luebbers, Bad Langensalza (DE)

(73) Assignee: LUEBBBRS ANLAGEN-UND UMWELTTECHNIK GMBH, Bad Langensalza (DE)

( * ) Notice: Subject to any disclaimer, the term of this patent is extended or adjusted under 35 U.S.C. 154(b) by 148 days.

(21) Appl. No.: 16/772,163

(22) PCT Filed: Dec. 13, 2018

(86) PCT No.: PCT/DE2018/200114
§ 371 (c)(1),
(2) Date: Jun. 12, 2020

(87) PCT Pub. No.: WO2019/114892
PCT Pub. Date: Jun. 20, 2019

(65) Prior Publication Data

US 2021/0071952 A1 Mar. 11, 2021

(30) Foreign Application Priority Data

Dec. 15, 2017 (DE) ..... 20 2017 107 664.4

(51) Int. Cl.
*F26B 23/02* (2006.01)
*F26B 3/06* (2006.01)
*F26B 21/10* (2006.01)

(52) U.S. Cl.
CPC ..... *F26B 23/02* (2013.01); *F26B 3/06* (2013.01); *F26B 21/10* (2013.01)

(58) Field of Classification Search
CPC ..... F26B 3/02; F26B 3/06; F26B 21/10
(Continued)

(56) References Cited

U.S. PATENT DOCUMENTS 3,102,795 A * 9/1963 Andrews ..... F26B 21/10 34/500
8,402,672 B2 * 3/2013 Nielsen ..... B01D 1/16 34/379

(Continued)

FOREIGN PATENT DOCUMENTS

DE 4326233 A1 * 2/1995 ..... B65B 9/067
DE 20 2017 100 733 U1 3/2017

(Continued)

*Primary Examiner* — Stephen M Gravini
(74) *Attorney, Agent, or Firm* — Norman B. Thot

(57) ABSTRACT

A heating compartment which provides heat. The heating compartment includes a combustion chamber which generates the heat via a combustion of a fuel, and at least one measuring sensor arranged within the heating compartment and/or at the combustion chamber. The at least one measuring sensor detects a measurement variable. The at least one measuring sensor has a self-sufficient energy supply system so that the at least one measuring sensor can operate independently of an external cable-based energy supply system.

10 Claims, 2 Drawing Sheets

(58) Field of Classification Search
USPC ..... 34/551
See application file for complete search history.

(56) References Cited

U.S. PATENT DOCUMENTS

| | | | | |
|---|---|---|---|---|
| 8,726,538 | B2 * | 5/2014 | Weisselberg | C02F 11/18 34/384 |
| 8,863,404 | B1 * | 10/2014 | Swanson | F26B 11/04 34/427 |
| 10,753,684 | B2 * | 8/2020 | Ringdal | F26B 5/042 |
| 11,046,891 | B2 * | 6/2021 | Buchert | C10G 1/002 |
| 2011/0252660 | A1 | 10/2011 | Hansen et al. | |
| 2018/0259252 | A1 * | 9/2018 | Kim | F26B 3/06 |
| 2019/0283066 | A1 * | 9/2019 | Rauser | F26B 21/10 |
| 2019/0316842 | A1 * | 10/2019 | Moll | F26B 21/10 |
| 2020/0049405 | A1 | 2/2020 | Lübbers | |
| 2021/0071952 | A1 * | 3/2021 | Luebbers | F26B 21/10 |
| 2021/0123675 | A1 * | 4/2021 | Wood | F26B 21/08 |
| 2021/0283649 | A1 * | 9/2021 | Ayotte | B05D 3/0263 |

FOREIGN PATENT DOCUMENTS

| | | | | |
|---|---|---|---|---|
| EP | 1 645 350 | A1 | 4/2006 | |
| WO | WO-9955442 | A1 * | 11/1999 | B01D 46/04 |
| WO | WO 2010/051816 | A2 | 5/2010 | |
| WO | WO-2018145701 | A1 * | 8/2018 | A23C 9/18 |
| WO | WO-2018145702 | A1 * | 8/2018 | F24H 3/105 |
| WO | WO-2019114892 | A1 * | 6/2019 | F26B 3/12 |

* cited by examiner

HEATING COMPARTMENT FOR SUPPLYING HEAT AND SPRAY DRYER FOR DRYING AN ARTICLE WHICH IS TO BE DRIED

CROSS REFERENCE TO PRIOR APPLICATIONS

This application is a U.S. National Phase application under 35 U.S.C. § 371 of International Application No. PCT/DE2018/200114, filed on Dec. 13, 2018 and which claims benefit to German Patent Application No. 20 2017 107 664.4, filed on Dec. 15, 2017. The International Application was published in German on Jun. 20, 2019 as WO 2019/114892 A1 under PCT Article 21(2).

FIELD

The present invention relates to a heating compartment for providing heat, wherein the heating compartment comprises a combustion chamber for generating heat by combustion of a fuel. The present invention also relates to a spray dryer for drying a product to be dried.

BACKGROUND

A heating compartment is used to provide heat that is generated by way of a direct or indirect firing procedure. An example of a heating compartment is an air heater for heating air for industrial purposes, for example, for drying a product that is to be dried in a drying tower and/or via a spray dryer. Particularly in the case of directly fired air heaters, fluctuations in the temperature of the heated air occur which, in the case of conventional temperature measuring procedures, is only determined at the site where the air is discharged from the air heater. The temperature may therefore no longer be corrected as the air enters the downstream spray dryer. These fluctuations in temperature lead to a deterioration in product quality and, as a result of the product to be dried becoming deposited because of the locally increased temperature, to an increased risk of fire and/or explosion.

SUMMARY

An aspect of the present invention is to improve upon the prior art.

In an embodiment, the present invention provides a heating compartment which is configured to provide heat. The heating compartment includes a combustion chamber which is configured to generate the heat via a combustion of a fuel, and at least one measuring sensor arranged within the heating compartment and/or at the combustion chamber. The at least one measuring sensor is configured to detect a measurement variable. The at least one measuring sensor comprises a self-sufficient energy supply system so that the at least one measuring sensor is operable independently of an external cable-based energy supply system.

BRIEF DESCRIPTION OF THE DRAWINGS

The present invention is described in greater detail below on the basis of embodiments and of the drawings in which.

DETAILED DESCRIPTION

Figure 1:
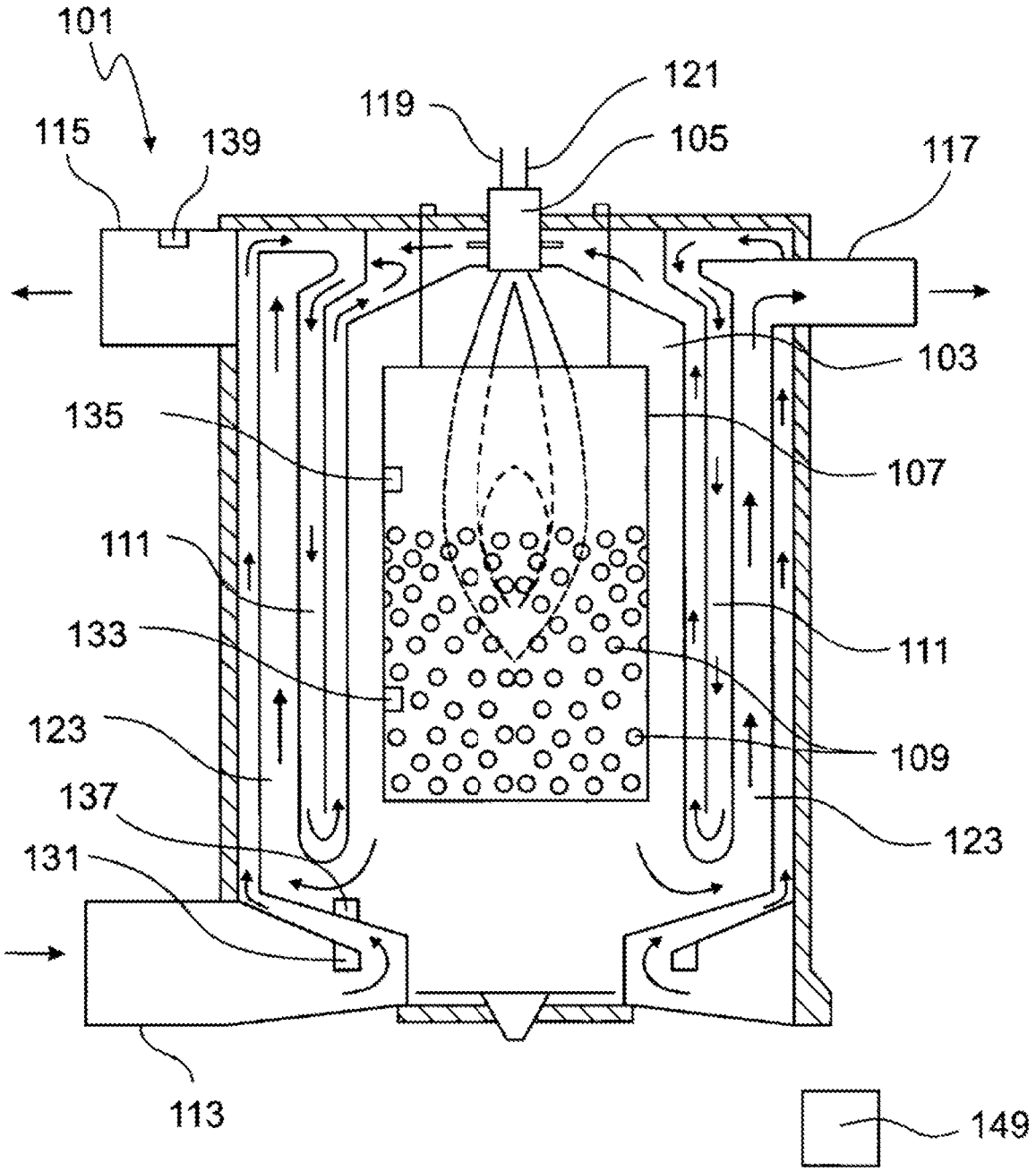
FIG. 1 shows a schematic sectional view of an air heater having a combustion chamber and six SAW temperature sensors.
Figure 2:
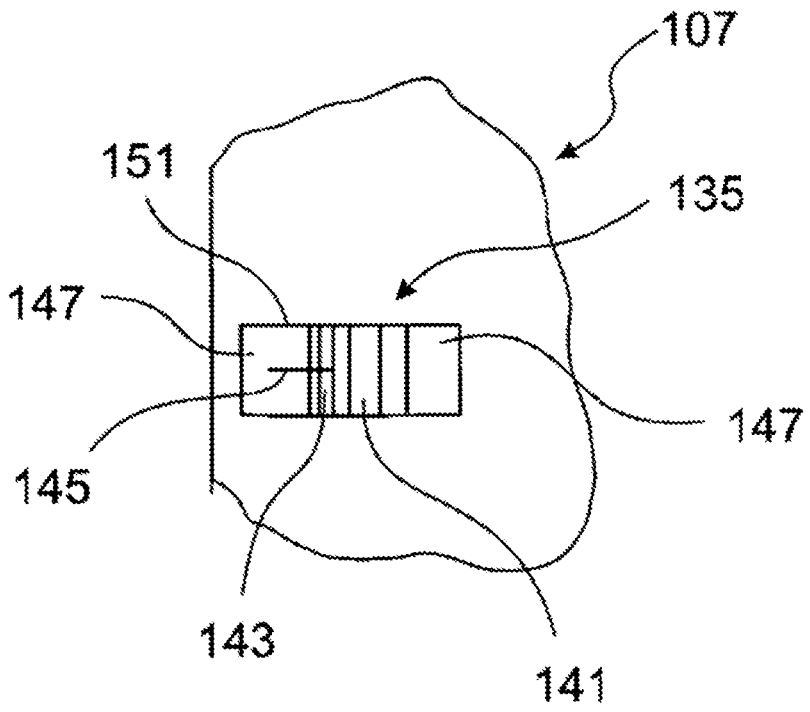
FIG. 2 shows a detailed view of a temperature sensor.

By virtue of the fact that a measuring sensor is arranged in the heating compartment so as to not need an external cable-based energy supply, it is, for example, possible to detect a temperature as a measurement variable directly in the heating compartment and/or at the combustion chamber.

The arrangement of multiple measuring sensors also makes it possible to detect a temperature distribution within the heating compartment and/or at the combustion chamber. The combustion process and/or the flow control procedure within the heating compartment can thereby be optimized.

It is therefore possible to realize a very constant temperature at the outlet of the heating compartment, for example, in the heated process air for industrial processes.

Because information for identifying the measuring sensor may also be transmitted via the associated transmitter of a measuring sensor, it is also possible to very quickly detect and/or replace a defective measuring sensor.

Using the receiver, it is possible to read and/or evaluate the measurement signals outside the heating compartment at ambient temperatures.

The term "heating compartment" is understood to mean a chamber in which heat is generated by combusting fuel in a combustion chamber in a heating compartment. During the combustion procedure, a high temperature in a range of approximately 500° C. to 1,200° C. prevails in the heating compartment. A heating compartment can, for example, be an air heater in which the flue gases from the combustion procedure discharge their heat to a process air that is to be heated in air-heating chambers. Heating compartments of this type are, for example, used in spray dryers.

A "measuring sensor" is in particular a technical component that detects specific physical and/or chemical characteristics of its environment in a qualitative and quantitative manner. A measuring sensor is in particular used to determine the quantity of heat, temperature, humidity, pressure, sound field variables, electrochemical potential and/or another characteristic. The detected qualitative or quantitative measurement variable is in particular converted by the measuring sensor into an electrical measurement signal that may be further processed. With respect to the energy used, a measuring sensor is in particular a passive sensor since it does not require any auxiliary electrical energy to generate an electrical signal.

The measuring sensor in particular comprises a current-generating piezo element. A measuring sensor is in particular a SAW sensor (service acoustic wave), for example, a SAW sensor element from the company SAW COMPONENTS Dresden GMBH that uses a surface acoustic wave that thereafter travels along a surface in only two dimensions of the SAW sensor. A SAW sensor in particular comprises a piezoelectrical substrate, to which metal structures are applied (transponder and reflector). In the case of a SAW sensor, a received incoming signal is in particular returned as an echo via the same antenna after the signal has passed through the surface acoustic wave structure and is reflected at two or multiple structures. The SAW sensor in particular uses the dependency of the surface wave velocity upon the mechanical stress and/or upon the temperature in this case. The SAW sensor is in particular constant in a wide temperature range of −55° C. to in excess of 1,200° C.

A "self-sufficient energy supply system" in particular means that the measuring sensor is supplied with the required energy that is generated exclusively by the measuring sensor itself or by an external receiver that is allocated to the measuring sensor. The self-sufficient energy supply system is in particular independent of the provision of the required energy via a battery and/or a current-carrying cable. A self-sufficient energy supply system may in particular provide energy continuously and consequently provide a very long service life of the measuring sensor of in excess of 10,000 hours, for example, in excess of 50,000 hours.

A "piezo element" is in particular a component which uses the piezo effect in order to generate an electrical voltage under the influence of a mechanical force. In particular in the case of a directed deformation of the piezo element, the electrical polarization changes and consequently an electrical voltage occurs at the piezo element. In the case of the directed deformation, the applied pressure in particular acts only from two opposite-lying sides on the piezo element. A directed deformation may consequently be realized, in particular by clamping the piezo element in two opposite-lying side walls, for example, of a cut-out in the combustion chamber.

A process air is provided via the heating compartment with an optimal drying temperature for a drying tower and/or a spray dryer. It is thereby possible to dry the product in a very homogenous manner and to realize a very high quality drying product.

The present invention will be further explained below under reference to an exemplary embodiment in the drawings.

An air heater 101 comprises a combustion chamber 103. A burner 105 is arranged on an upper face of the combustion chamber 103. The burner 105 is connected to a combustion air feed-in 119 and a combustion gas feed-in 121. A sacrificial combustion chamber 107 having a multiplicity of holes 109 is arranged below the burner 105 in the middle of the combustion chamber 103.

The air heater 101 also comprises a circumferential process air inlet 113 at the bottom. The air heater 101 comprises on its upper face and on its side walls a circumferential air-heating chamber 111 that is configured as meandering flow ducts. The air-heating chamber 111 ends in a process air outlet 115. The combustion chamber 103 is connected to a circumferential flue gas discharge duct 123 that ends in a flue gas outlet 117.

A first SAW temperature sensor 131 is arranged in the process air inlet 113 in the air heater 101. A second SAW temperature sensor 133 is arranged in the lower region and a third SAW temperature sensor 135 is arranged in the upper region of the sacrificial combustion chamber 107. A fourth SAW temperature sensor 137 is arranged in the transition area from the combustion chamber 103 into the flue gas discharge duct 123. A fifth SAW temperature sensor 139 is arranged in the process air outlet 115. A sixth SAW temperature sensor (which is not specifically labelled in the drawings) is arranged in the process air inlet on a side opposite to the first SAW temperature sensor 131.

The first SAW temperature sensor 131, the second SAW temperature sensor 133, the third SAW temperature sensor 135, the fourth SAW temperature sensor 137 and the fifth SAW temperature sensor 139 comprise in each case a piezoelectrical substrate 141, a transmitter 143, an antenna 145 and a dimension of 5×3 $mm^2$ and a weight of 2 g. An external receiver 149 is arranged outside the air heater 101 below the ambient temperature.

The second SAW temperature sensor 133 and the third SAW temperature sensor 135 are arranged in each case in a cut-out 151 of the sacrificial combustion chamber 107. For protection purposes, the second SAW temperature sensor 133 and the third SAW temperature sensor 135 are in each case embedded together with their associated antenna 145 in the cut-out 151 using quartz glass 147 as a potting material so that the cut-out 151 is completely filled with quartz glass 147. The respective piezoelectrical substrate 141 of the second SAW temperature sensor 133 and of the third SAW temperature sensor 135 are in each case fixedly clamped in a vertical dimension of the cut-out 151. In contrast, the horizontal orientation of the second SAW temperature sensor 133 and the third SAW temperature sensor 135 is less than the horizontal dimension of the cut-out 151.

In the air heater 101, a combustion gas is supplied via the combustion gas feed-in 121 and a combustion air is supplied via the combustion air feed-in 119 to the burner 105 combusted, wherein a corresponding flame is formed within the sacrificial combustion chamber 107. The flue gases that form flow through the holes 109 of the sacrificial combustion chamber 107 into the combustion chamber 103.

Thermal energy that is generated during the combustion is discharged from the combustion chamber 103 to the air-heating chamber 111. For this purpose, process air is continuously introduced at an ambient temperature of 20° C. via the process air inlet 113 into the air-heating chamber 111, the process air being measured by the first SAW temperature sensor 131 and transmitted to the external receiver 149. The flue gases that form flow through the flue gas discharge duct 123 that comprises contact surfaces to the air-heating chamber 111 so that thermal energy of the flue gases is discharged to the process air in the air-heating chamber 111. The process air therefore heats up as it passes through the air-heating chamber 111 and leaves the process air outlet 115 at a temperature of 300° C. that is measured by the fifth SAW temperature sensor 139 and transmitted to the external receiver 149. After leaving the process air outlet 115 of the air heater 101, this heated process air is supplied directly to a drying tower for drying milk.

During the combustion of the combustion gases in the air heater 101, the five SAW temperature sensors 131, 133, 135, 137 and 139 in each case measure the temperature and transmit their temperature measurement signals in each case via their transmitter 143 and their antenna 145 to the external receiver 149 outside the air heater 101. The second SAW temperature sensor 133 and the third SAW temperature sensor 135 receive their electrical voltage supply for measuring purposes and for transmitting the temperature measurement signals via the piezoelectrical substrate that is clamped in the respective cut-out 151 and, because of the clamping arrangement, the substrate in each case generates an electrical voltage.

The first SAW temperature sensor 131, the fourth SAW temperature sensor 137 and the fifth SAW temperature sensor 139 obtain a discontinuous electrical voltage supply from the received signal of the external receiver 149.

The five SAW temperature sensors 131, 133, 135, 137 and 139 transmit their temperature measurement signals and associated information for identification at different frequencies in the band width of 2.400 MHz to 2.483 MHz. The external receiver 149 may therefore unambiguously identify the five SAW temperature sensors 131, 133, 135, 137 and 139 and unambiguously allocate the transmitted temperature signals thereto. The external receiver 149 monitors the temperature signals of the five SAW temperature sensors 131, 133, 137, 137 and 139 during the combustion of the combustion gases in the combustion chamber 103.

In this case, it is intermittently established that the temperature difference of 50° C. between the second SAW temperature sensor 133 and the third SAW temperature sensor 135 is too high and, as a result, the temperature that is measured by the fifth SAW temperature sensor 139 lies below the desired temperature of 300° C. at the process air outlet 115. The supply of combustion gas at the combustion gas feed-in 121 and the supply of combustion air at the combustion air feed-in 119 is therefore increased via a programmable logic controller (which is not illustrated in the drawings) so that combustion is improved. The second SAW temperature sensor 133 and the third SAW temperature sensor 135 thereafter detect an increasing, equalizing temperature and, after transmitting the temperature measurement signals to the external receiver 149, the external receiver 149 detects that the desired temperature of 800° C. once again prevails at the sacrificial combustion chamber 107 and the desired process air outlet temperature of 300° C. again prevails at the process air outlet on the basis of the temperature measurement value of the fifth SAW temperature sensor 139.

An air heater is therefore provided that, on the basis of monitoring the temperature at different sites within the air heater, provides a uniform heat distribution and consequently an optimal use of the combustion gas and an optimal process air temperature for a subsequent drying process in a spray dryer.

The present invention is not limited to embodiments described herein; reference should be had to the appended claims.

LIST OF REFERENCE NUMERALS

101 Air heater
103 Combustion chamber
105 Burner
107 Sacrificial combustion chamber
109 Holes
111 Air-heating chamber
113 Process air inlet
115 Process air outlet
117 Flue gas outlet
119 Combustion air feed-in
121 Combustion gas feed-in
123 Flue gas discharge duct
131 First SAW temperature sensor
133 Second SAW temperature sensor
135 Third SAW temperature sensor
137 Fourth SAW temperature sensor
139 Fifth SAW temperature sensor
141 Piezoelectrical substrate
143 Transmitter
145 Antenna
147 Quartz glass/Potting material
149 External receiver
151 Cut-out

What is claimed is:

1. A heating compartment which is configured to provide heat, the heating compartment comprising:

a combustion chamber which is configured to provide the heat via a combustion of a fuel;

a material;

and at least one measuring sensor arranged at least one of within the heating compartment and at the combustion chamber, the at least one measuring sensor being configured to detect a measurement variable, the at least one measuring sensor comprising a self-sufficient energy supply system so that the at least one measuring sensor is operable independently of an external cable-based energy supply system, wherein, at least one of the at least one measuring sensor and the self-sufficient energy supply system of the at least one measuring sensor is clamped in the material of at least one of the heating compartment and the combustion chamber, and at least one of the at least one measuring sensor and the self-sufficient energy supply system of the at least one measuring sensor comprises a piezo element.

2. The heating compartment as recited in claim 1, further comprising:

a plurality of the at least one measuring sensor, wherein, the plurality of the at least one measuring sensor is arranged at least one of within the heating compartment and at the combustion chamber to detect a gradient of the measurement variable.

3. The heating compartment as recited in claim 1, wherein the at least one measuring sensor is at least one of a SAW sensor, a temperature sensor, and a pressure sensor.

4. The heating compartment as recited in claim 3, wherein the temperature sensor is configured to measure a temperature in a range of 20° C. to 1,200° C.

5. The heating compartment as recited in claim 1, wherein the at least one measuring sensor further comprises a transmitter and an antenna which are configured to provide a wireless transmission of a measurement signal.

6. The heating compartment as recited in claim 5, further comprising:

a potting material, wherein, at least one of the at least one measuring sensor and the antenna is molded in the potting material.

7. The heating compartment as recited in claim 5, further comprising:

an external receiver which is allocated to the at least one measuring sensor, the external receiver being configured to at least one of read, evaluate, and monitor the measurement signal.

8. The heating compartment as recited in claim 5, wherein the transmitter comprises a frequency in a range of 9 kHz to 300 GHz.

9. The heating compartment according as recited in claim 5, wherein information for identifying the at least one measuring sensor is transmissible via the transmitter.

10. A spray dryer for drying a product to be dried, wherein the spray drier is allocated the heating compartment as recited in claim 1 so that an airflow with a homogenous temperature distribution is suppliable from the heating compartment to the spray dryer.

* * * * *